US012129067B1

(12) United States Patent
Juenger et al.

(10) Patent No.: US 12,129,067 B1
(45) Date of Patent: Oct. 29, 2024

(54) SEPARATING DEVICE AND METHOD FOR SEPARATING A BLISTER TUBE, AND PACKAGING DEVICE COMPRISING A SEPARATING DEVICE

(71) Applicant: Becton Dickinson Rowa Germany GmbH, Kelberg (DE)

(72) Inventors: Thomas Juenger, Oberelz (DE); Thomas Horten, Boxberg (DE)

(73) Assignee: Becton Dickinson Rowa Germany GmbH, Kelberg (DE)

( * ) Notice: Subject to any disclaimer, the term of this patent is extended or adjusted under 35 U.S.C. 154(b) by 0 days.

(21) Appl. No.: 18/137,607

(22) Filed: Apr. 21, 2023

(51) Int. Cl.
*B65B 9/08* (2012.01)
*B65B 41/16* (2006.01)
*B65B 61/04* (2006.01)

(52) U.S. Cl.
CPC ..... *B65B 61/04* (2013.01); *B65B 9/08* (2013.01); *B65B 41/16* (2013.01)

(58) Field of Classification Search
USPC ..... 53/547
See application file for complete search history.

(56) References Cited

U.S. PATENT DOCUMENTS

| | | | | |
|---|---|---|---|---|
| 2004/0149767 | A1 | 8/2004 | Boehm et al. | |
| 2006/0010835 | A1* | 1/2006 | Shaw | B65B 61/12 53/500 |
| 2014/0230376 | A1* | 8/2014 | Knoth | B65B 9/045 53/452 |
| 2022/0002011 | A1* | 1/2022 | Gross | B65B 9/207 |

FOREIGN PATENT DOCUMENTS

| | | | |
|---|---|---|---|
| DE | 2341644 | A1 | 4/1974 |
| EP | 2714526 | B1 | 3/2016 |
| EP | 3385174 | A1 | 10/2018 |
| EP | 3545938 | A1 | 10/2019 |
| JP | 2021079965 | A | 5/2021 |
| WO | WO-2013034504 | A1 | 3/2013 |

OTHER PUBLICATIONS

Extended European Search Report for Application No. 23169149.4, dated Nov. 2, 2023, 15 pages including translation.
International Search Report and Written Opinion for Application No. PCT/EP2024/053723, dated Jun. 18, 2024, 14 pages including translation.

* cited by examiner

*Primary Examiner* — Chinyere J Rushing-Tucker
(74) *Attorney, Agent, or Firm* — Morgan, Lewis & Bockius LLP

(57) ABSTRACT

Separating devices for a blister tube include a blister tube feed device comprising a first transport means and an associated first transport means bearing, a blister discharging device arranged downstream of the blister tube feed device and comprising a second transport means and an associated second transport means bearing, a first drive coupled to the first transport means, and a second drive coupled to the second transport means, and a control device coupled to the first and second drives, the control device configured to temporarily exert a tensile force on the second portion of the blister tube in the transport direction with the aid of the second transport means, the tensile force being dimensioned in such a way that the second portion of the blister tube is separated from the first portion of the blister pouch at a separation aid. Methods and packaging devices using separating devices are also provided.

18 Claims, 6 Drawing Sheets

SEPARATING DEVICE AND METHOD FOR SEPARATING A BLISTER TUBE, AND PACKAGING DEVICE COMPRISING A SEPARATING DEVICE

BACKGROUND

The disclosure relates to a separating device for a blister tube comprising a plurality of blister pouches, to a method for separating such a blister tube, to a packaging device comprising a separating device, and to the use thereof.

SUMMARY

One or more embodiments include a separating device for a blister tube having a plurality of blister pouches, the separating device including a blister tube feed device comprising a first transport means and an associated first transport means bearing configured so that a first portion of the blister tube is guided, clamped between the first transport means and the first transport means bearing, in a transport direction so that slippage relative to the first transport means is prevented. The separating device also includes a blister discharging device arranged downstream of the blister tube feed device, the blister discharging device comprising a second transport means and an associated second transport means bearing configured so that a second portion of the blister tube is clamped between the second transport means and the second transport means bearing in a slip-resistant manner relative to the second transport means, wherein the blister tube feed device and the blister discharging device are arranged in such a way that between the first portion and the second portion of the blister tube, a separation aid is arranged between two blister pouches. The separating device further includes a first drive coupled to the first transport means, a second drive coupled to the second transport means and a control device coupled to the first drive and to the second drive. The control device is configured to temporarily exert, with the aid of the second transport means, a tensile force in the transport direction on the second portion of the blister tube, the tensile force being dimensioned in such a way that the second portion of the blister tube is separated from the first portion of the blister pouch at the separation aid.

One or more embodiments include a method for separating a blister tube having a plurality of blister pouches, the method including arranging a separation aid between individual blister pouches of the blister tube; feeding the blister tube to a blister tube feed device comprising a first transport means and an associated first transport means bearing; guiding a first portion of the blister tube, clamped between the first transport means and the first transport means bearing, in such a way that slippage relative to the first transport means is prevented; moving the blister tube via the clamped first portion by the first transport means in a transport direction at a feed speed; feeding the blister tube to a blister discharging device arranged downstream of the blister tube feed device and comprising a second transport means and an associated second transport means bearing; clamping a second portion of the blister tube between the second transport means and the second transport means bearing in a slip-resistant manner relative to the second transport means so that a separation aid is arranged between the blister tube feed device and the blister discharging device; and exerting, with the aid of the second transport means, a tensile force on the second portion of the blister tube in the transport direction, the tensile force being dimensioned in such a way that the second portion of the blister tube is separated from the first portion of the blister pouch at the separation aid.

One or more embodiments include a packaging device for small piece goods, the packaging device including a packaging material guide device for receiving an elongate packaging material web, the packaging material guide device configured so that the elongate packaging material web is shaped for receiving small piece goods and extends in a movement direction; a longitudinal joining device arranged downstream of the packaging material guide device, the longitudinal joining device configured to join together the shaped packaging material web at a packaging material overlap region in the movement direction of the packaging material web; a transverse joining device arranged downstream of the packaging material guide device, the transverse joining device configured to join together the shaped packaging material web at predetermined distances transversely to the movement direction to form a transverse joining region, as a result of which a blister tube comprising a plurality of blister pouches is formed, the transverse joining device comprising two joining devices, of which at least one joining device is movable transversely to the movement direction; and a separating device. The separating device includes a blister tube feed device comprising a first transport device and an associated first transport device bearing configured so that a first portion of the blister tube is guided, clamped between the first transport device and the first transport device bearing, in a transport direction so that slippage relative to the first transport device is prevented; a blister discharging device arranged downstream of the blister tube feed device, the blister discharging device comprising a second transport device and an associated second transport device bearing configured so that a second portion of the blister tube is clamped between the second transport device and the second transport device bearing in a slip-resistant manner relative to the second transport device, wherein the blister tube feed device and the blister discharging device are arranged in such a way that between the first portion and the second portion of the blister tube, a separation aid is arranged between two blister pouches; a first drive coupled to the first transport device; a second drive coupled to the second transport device; and a control device coupled to the first drive and to the second drive, wherein the control device is configured to temporarily exert, with the aid of the second transport device, a tensile force in the transport direction on the second portion of the blister tube, the tensile force being dimensioned in such a way that the second portion of the blister tube is separated from the first portion of the blister pouch at the separation aid.

The foregoing and other features, aspects and advantages of the disclosure will become more apparent from the following detailed description and accompanying drawings.

BRIEF DESCRIPTION OF DRAWINGS

In the following, aspects of separating devices according to the disclosure for a blister tube, aspects of methods for separating a blister tube and aspects of a packaging device according to the disclosure comprising the separating device are described with reference to the drawings, in which.

DETAILED DESCRIPTION

Figure 1A:
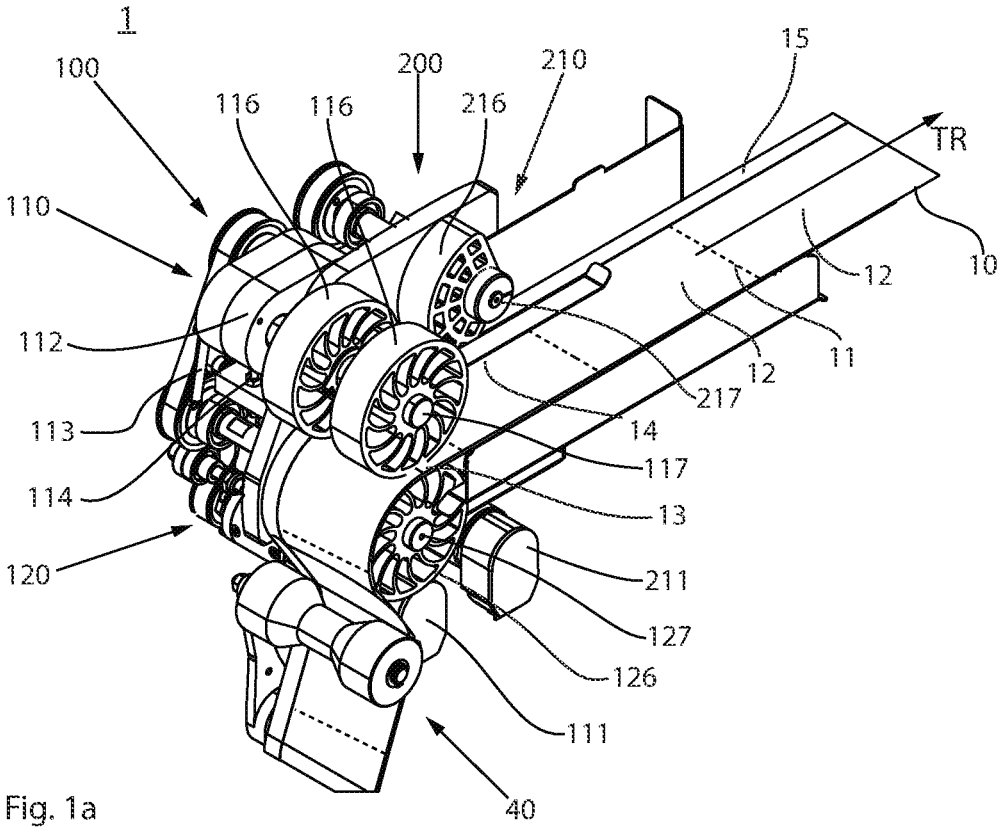
FIGS. 1*a* and 1*b* are perspective views of a separating device together with the blister tube, according to the disclosure.

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments or aspects described in the present disclosure may be carried out in different ways and variations, and in accordance with a desired application or implementation.

Packaging devices are inter alia used in blister machines, as are known, for example, from WO 2013/034504 A1. Depending on the expansion stage, the blister machines comprise several hundred supply and dispensing stations, in each of which a plurality of drug portions or food supplement portions (hereinafter referred to for short as "portions," more generally also as "small piece goods") of a specific type are stored. Upon request, individual portions can be dispensed from the supply and dispensing stations and are then fed via a guide device to a packaging device, in which the portions are packaged or blister-packaged.

During the blister-packaging, a packaging material web is formed from the packaging device into a blister tube with a plurality of blister pouches arranged one behind the other, one or more small piece goods being arranged in the blister pouches. In the case of applications in the medical field, the small piece goods are regularly drug portions or food supplement portions. In non-medical applications, however, screws, nuts and the like can also be blister-packaged.

Usually, the forming blister tube is guided out of the blister machine and either rolled up using a separate device to form a blister tube roll and subsequently stored, transported or further processed.

It may also be provided that before being rolled up, the blister tube is fed to what is known as an inspector, which verifies the target arrangements of the small piece goods in the blister pouches and marks pouches comprising incorrect contents.

Regardless of the further use of the blister tube, it is necessary, due to its nature (blister pouch for a large number of patients in a strand or tube) to separate it into suitable segments. The segment size is variable; it is conceivable to separate segments per patient; however, larger segments (segment per department in a hospital) as well as small segments (blister pouch per patient per administration time) are also conceivable.

Usually, the separation is performed by a trained user, who performs the separation on the basis of printed information or instructions, for example. However, such a manual separation is very prone to errors and is a monotonous unwelcome activity for a user. The separation by a user also makes it necessary for the separation of the blister tube to take place outside the blister machine.

In aspects of the disclosure, a separating device for a blister tube comprising a plurality of blister pouches and a method by means of which the separation can take place in an automated manner and optionally within a blister machine are provided.

The separating device according to the disclosure for a blister tube comprising a plurality of blister pouches comprises a blister tube feed device comprising a first transport means and an associated first transport means bearing, which are designed in such a way that a first portion of the blister tube is guided, clamped between the first transport means and the first transport means bearing, in a transport direction so that slippage relative to the first transport means is prevented, a blister discharging device which is arranged downstream of the blister tube feed device and comprises a second transport means and an associated second transport means bearing, which are designed in such a way that a second portion of the blister tube can be clamped between the second transport means and the second transport means bearing in a slip-resistant manner relative to the second transport means, the blister tube feed device and the blister discharging device being arranged in such a way that between the first portion and the second portion of the blister tube, a (viz. exactly one) separation aid can be arranged or is arranged (if separation is intended) between two blister pouches, a first drive coupled to the first transport means, and a second drive coupled to the second transport means, and a control device coupled to the first and second drives.

According to the disclosure, the control device is designed to temporarily exert a tensile force ZK, in the transport direction TR, on the second portion of the blister tube with the aid of the second transport means, the tensile force being dimensioned in such a way that the second portion of the blister tube is separated from the first portion of the blister pouch at the separation aid.

The separating device according to the disclosure is kept structurally simple and comprises only a few components so that it can be integrated without problems in known blister machines. For the separation per se, no special cutting tool is used, but rather a tensile force is exerted on the second portion of the blister pouch at a predetermined time, which force ensures a separation of the second portion from the first portion, viz. at the predetermined separation point, which is predetermined by a separation aid. This is a specifically arranged weak point of the material, for example in the form of a perforation or the like. In order to apply the tensile force, the transport means are controlled via the control device in such a way that they transfer different transport speeds to the blister pouch. For this purpose, it is provided according to the disclosure that the blister pouch is arranged or clamped between the transport means and the transport means bearings in a slip-resistant manner with respect to the transport means. In this case, the clamping force is to be selected such that the tensile force causes a separation at the separation aid before a portion of the blister tube slips through between the transport means and the transport means bearing. The way in which the forces required for the separation per se are dimensioned and generated depends on the exact construction of the transport means and the nature of the blister tube and the separation aid.

Another advantage of the device according to the disclosure is that a blister tube can be separated thereby without the blister-packaging speed of an optionally upstream packaging device having to be restricted. The blister tube can run through the separating device without clocking, as is apparent in particular from the method according to the disclosure described further below.

The device according to the disclosure furthermore has the advantage that no knives, scissors or other cutting tools are used, the risk of injury to a user is minimized.

The exact way in which the clamping effect is generated in the first and second transport means is not essential for the disclosure and depends on the exact design of the separating device. It is conceivable that transport means and/or transport means bearings are adjustable vertically. In the case of the second transport means and the associated transport means bearing, it is not necessary for them to always be in contact with the blister tube. The clamping and the exertion of the tensile force must only take place when two adjacent blister pouches are to be separated using a separation aid arranged between them.

In aspects of the disclosure, it is provided that at least one of the transport means has an elastically deformable coating, preferably a silicone coating, in the contact region to the blister tube. In the contact region to the blister tube, the coating is compressed, producing at least a force-fit between the transport means and the blister tube. Depending on whether in the contact region, an item of small piece goods is also arranged in a blister pouch, a form-fit can also temporarily be produced. The clamping force is exerted as a result of the restoring force of the elastically deformable coating; the force-fit and, optionally, form-fit, prevents slippage relative to the transport means. How exactly the coating must be formed again depends on the structural details and also on the operation of the separating device. It is essential that the aforementioned functions are provided.

Alternatively or additionally, it may be provided that the first or both transport means comprises or comprise a spring means which presses or pulls a transport means against or onto the first transport means bearing. The spring force of the spring means impacts the clamping effect and is to be adjusted accordingly.

How exactly the first and second transport means is/are formed is not essential for the disclosure. It is only essential that they bring about a translational movement of an associated portion of the blister pouch or transmit said movement to said portion. For example, the transport means may comprise a transport belt that comes into contact with a portion of the blister pouch. In the case of a structurally simple and spatially less demanding separating device, it is provided that the first and/or the second transport means has a first or second transport roller, each transport roller and the transport means bearing(s) preferably being arranged in such a way that the first and/or the second portion is a side region of the blister tube. The preferred arrangement of the transport roller(s) ensures that the contact region between the transport means and the blister pouch portion is placed in a region of the blister pouch in which few or no small piece goods are arranged. If a transport roller, for example, only comes into contact with the blister tube in the longitudinal joining region of the blister tube, it is ensured that no small piece goods are arranged in this region. If this is not the case, it must be ensured that the transport means and/or the transport means bearing is vertically flexible, which can be achieved, for example, by the aforementioned elastically deformable coating.

In order to ensure the most uniform possible transport of the blister tube, it is provided, in a development of the above-described separating device, that the first and/or second transport roller is designed as a first or second transport double roller, the first and/or second transport double roller and the first and/or second transport means bearing preferably being designed and arranged in such a way that the first and/or second portion comprises both side regions of the blister tube.

In aspects of the disclosure, it is furthermore additionally provided that the first and/or second transport means bearing is designed as a first or second bearing roller, the first and/or second bearing roller and the first and/or second transport roller preferably being arranged in such a way that the first and/or second portion is a side region of the blister tube.

Here too, it may be provided, in a development, that the first and/or second bearing roller is designed as a first or second bearing double roller, the first and/or second bearing double roller and the first and/or second transport double roller preferably being designed and arranged in such a way that the first and/or second portion comprises both side regions of the blister tube.

As explained above, the first transport means and the first transport means bearing are constantly in contact with the blister tube, viz. in order to ensure transport per se in and through the separating device. Such a constant contact can also be present in the case of the second transport means or transport means bearing, but this is not mandatory since the functionality of the second transport means (the transmission of a tensile force) does not have to be provided constantly. In aspects of the disclosure, it is provided that the second transport means and the second transport means bearing are designed as circular sector rollers comprising at least one sector element, the circular sector rollers being matched to one another for contacting the second portion of the blister tube. Here, the tensile force is exerted by rotating the circular sector rollers for, for example, one revolution at a speed that induces a higher translational speed than the first transport means. This difference determines the tensile force that causes the separation at the separation aid. The circular sector rollers are thus only in contact with the second portion of the blister pouch if a separation between the first and second portions is to take place.

As indicated above, it may be expedient to guide the small piece goods, arranged in a blister pouch, from the side region (in relation to the transport direction) into the central region of a blister pouch in order to avoid contacting with a transport means. It is therefore provided in one or more embodiments that the separating device has, upstream of the blister tube feed device, a small piece goods guide which guides small piece goods contained in a blister pouch from the side regions of a blister pouch into the central region.

For a separation to take place, a separation aid must be provided at least between the blister pouches to be separated. This separation aid can be introduced in the region of the transverse joining, for example during the blister-packaging upstream of the separation. However, in order that the separating device can also be operated with blister machines that do not directly introduce separation aids during the blister-packaging, it is provided in one or more embodiments that the separating device comprises, upstream of the blister tube feed device, a device for introducing separation aids between blister pouches of the blister tube.

A method according to the disclosure for separating a blister tube comprising a plurality of blister pouches comprises the steps that a blister tube is provided, in which a separation aid is arranged between individual blister pouches, the blister tube is fed to a blister tube feed device comprising a first transport means and an associated first transport means bearing, and a first portion of the blister tube is guided, clamped between the first transport means and the first transport means bearing, in such a way that slippage relative to the first transport means is prevented, the blister tube is moved via the clamped first portion by the first transport means in a transport direction TR at a feed speed, the blister tube is fed to a blister discharging device which is arranged downstream of the blister tube feed device and comprises a second transport means and an associated second transport means bearing, a second portion of the blister tube is clamped between the second transport means and the second transport means bearing in a slip-resistant manner relative to the second transport means so that a separation aid is arranged between the blister tube feed device and the blister discharging device, and by means of the second transport means, a tensile force is temporarily exerted, in the transport direction TR, on the second portion of the blister tube, which tensile force is dimensioned in such a way that the second portion of the blister tube is separated from the first portion of the blister pouch at the separation aid.

As already explained above, a separation between two portions of the blister tube is brought about by exerting a tensile force on the second portion. In this case, the first portion and the second portion denote regions of two adjacent blister pouches, between which a separation aid is arranged. This illustrates that a separation aid must be arranged or introduced only between blister pouches that are to be separated from one another. How exactly the separation takes place, i.e., how many blister pouches are separated, is irrelevant here, and all individual pouches of a blister tube may also be separated. For this purpose, it is of course necessary for blister pouches comprising enclosed small piece goods to be separated from one another, i.e., portions of filled blister pouches are also clamped in such a way that a separation can be achieved. However, this is entirely possible with a corresponding arrangement of the transport means and transport bearings, and/or a corresponding coating. In particular in the case that larger segments of the blister tube are separated from one another (i.e., for example, per department or, for example, weekly rations of a patient), it is also conceivable for empty pouches (with respect to small piece goods) to be introduced between the blister pouches comprising small piece goods, which empty pouches are then separated from one another so that each separated blister tube segment begins and ends with an empty pouch. These empty pouches can contain (additional) information about or for a patient, etc. If the method is performed on a separating device which is arranged outside a blister machine and/or possibly does not or cannot obtain any information about blister pouches to be separated from, for example, the central control device of the blister machine, the empty pouches can also function as an indication that a separation is to take place. For this purpose, the pouches can have certain information, which is recognized by the separating device ("separate blister tube between this and the subsequent blister pouch").

According to the disclosure, the separation is achieved by exerting a tensile force which ensures a separation of the second portion of the blister pouch from the first portion of the blister pouch at a separation aid. In one or more embodiments, the tensile force is exerted by using the second transport means to induce a discharge speed of the second portion that is greater than the feed speed. Alternatively, the tensile force is exerted by moving the second portion of the blister tube, by means of the second transport means, in the transport direction TR at a discharge speed and reducing the feed speed, induced by the first transport means, relative to the discharge speed. The process control that is preferred (also) depends on the exact structural design of the separating device used.

In aspects of the disclosure, which can also be used in the case of a blister tube without separation aids, it is provided that the separation aids are introduced before the blister tube is fed to the blister tube feed device.

The disclosure furthermore relates to a packaging device for small piece goods, comprising: a packaging material guide device for receiving an elongate packaging material web, the packaging material guide device being designed in such a way that the elongate packaging material web is shaped in such a way that it is suitable for receiving small piece goods and extends in a movement direction, a longitudinal joining device which is arranged downstream of the packaging material guide device and joins together the shaped packaging material web at a packaging material overlap region in the movement direction of the packaging material web, a transverse joining device which is arranged downstream of the packaging material guide device and joins together the shaped packaging material web at predetermined distances transversely to the movement direction to form a transverse joining region, as a result of which a blister tube comprising a plurality of blister pouches is formed, the transverse joining device comprising two joining means, of which at least one joining means is movable transversely to the movement direction.

A corresponding packaging device is described in EP 3 385 174 A1, the disclosure content of which is hereby incorporated in its entirety into this application so that a more detailed description of the individual components can be dispensed with.

According to the disclosure, the packaging device furthermore comprises a separating device as described above.

The disclosure also relates to the use of a separating device as described above for separating a blister tube comprising a plurality of blister pouches.

Figure 1B:
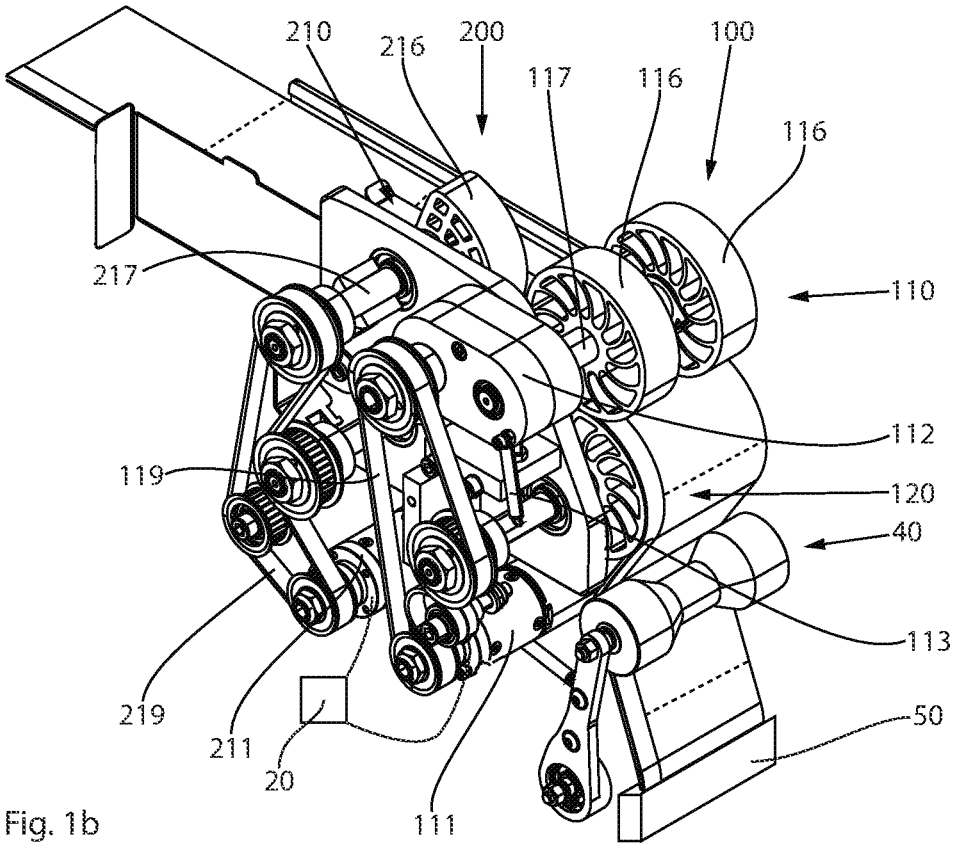
Figure 2A:
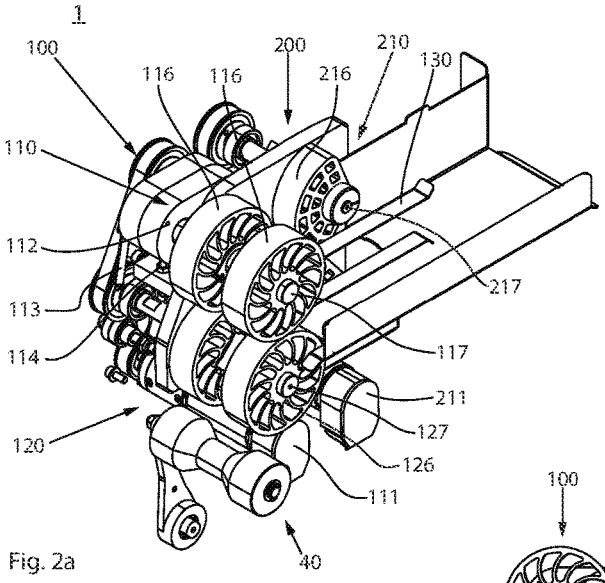
FIGS. 2*a* and 2*b* are partial perspective views of the separating device of FIGS. 1*a* and 1*b* with the blister tube being omitted, according to the disclosure.
Figure 2B:
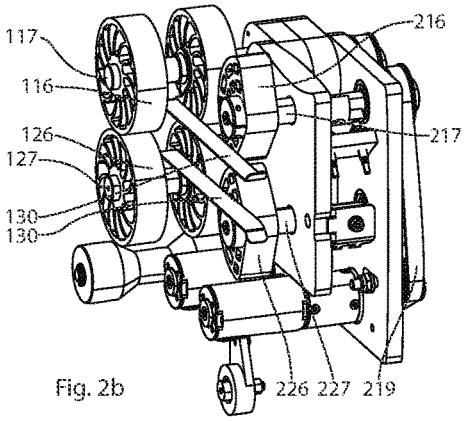

FIGS. 1*a*, 1*b* and 2*a*, 2*b* show oblique views of a separating device 1 according to the disclosure, a blister tube being omitted in FIGS. 2*a* and 2*b* for the sake of clarity. FIGS. 1*a* and 1*b* show a blister tube 10 comprising a plurality of blister pouches 12 guided through the separating device. A separation aid 11, at which the blister tube 10 is separated by means of the separating device 1 according to the disclosure, is arranged in each case between two blister pouches 12 arranged in the longitudinal direction or transport direction TR of the blister tube 10. For example, the separation aid 11 can be a perforation which specifies an intended separation point. A longitudinal weld 15 is indicated in the left-hand side region (in the transport direction TR) of the blister tube 10.

The separating device 1 itself comprises two main components, namely a blister tube feed device 100 and a blister discharging device 200 arranged downstream of the blister tube feed device 100 (in the transport direction TR of the blister tube 10) but shown only in part in FIGS. 1*a* and 1*b*. The blister tube feed device 100 comprises a first transport means 110 and a first transport means bearing 120 associated with the first transport means 110. The first transport means 110 and the first transport means bearing 120 are designed in such a way that a first portion 13 of the blister tube 10 is guided, clamped between the first transport means 110 and the first transport means bearing 120, in the transport direction TR, the first transport means 110 and the first transport means bearing 120 being designed in such a way that slippage of the clamped region of the blister tube 10 relative to the first transport means 110 is prevented.

How exactly the blister tube 10 is guided, as defined above, and clamped or fixed is not essential for the disclosure; all that is essential is that the blister tube 10 is held between the transport means 110 and the transport means bearing 120 when a tensile force is exerted on the blister tube 10 in the transport direction TR. As shown in FIGS. 1*a* and 1*b*, the first transport means 110 and the first transport means bearing 120 are designed as a transport double roller and a bearing double roller, respectively, in each case comprising two spaced apart transport or bearing rollers 116; 126, each of which is arranged on a shaft 117; 127, which are coupled to a first drive 111 via a belt drive 119. The first transport means 110 comprises a transmission 112 via which the shaft 117 is height-adjustable. As shown, the transmission 112 itself is pulled by a tensioned spring means 113 in the direction of the first transport means bearing 120, as a result of which, inter alia, the clamping effect is exerted on the first portion 13 of the blister tube 10 which is guided between the first transport means 110 and the first transport means bearing 120. Alternatively, the part of the transmission 112 guiding the shaft 117 could be pressed from above by means of an alternatively arranged spring means, for example, or could be pressed by a weight.

The separating device 1 according to the disclosure as shown, in which the first transport means 110 and the first transport means bearing 120 are designed as a transport double roller and bearing double roller, respectively, the individual rollers 116, 126 of which are arranged at a distance from one another on the respective shafts 117, 127, the transport and bearing rollers 116, 126 contact the blister tube 10 in relation to the longitudinal direction or transport direction TR of the blister tube 10, in the side regions of the blister tube 10. The first portion 13 of the blister tube contacted by the first transport means 110 thus extends on two lateral partial regions of the blister tube 10.

Figure 3:
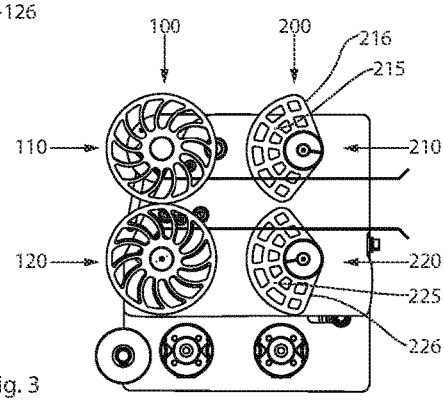
FIG. 3 is a side view of the separating device of FIGS. 1*a* and 1*b*, according to the disclosure.

Downstream of the blister tube feed device 100, a blister discharging device 200 is arranged, which comprises a second transport means 210 and a second transport means bearing 220 (see FIGS. 2*a* to 3). In the separating device 1, the second transport means 210 and the second transport means bearing 220 are not designed as a transport double roller and bearing double roller, respectively, but as circular sector rollers 216; 226 (see again FIGS. 2*a* to 3). As shown, the circular sector rollers each comprise a sector element 215, 225 (see in particular FIG. 3), which are arranged on corresponding shafts 217, 227. The second transport means 210 and the second transport means bearing 220 are designed in such a way that a second portion 14 of the blister tube 10 (see FIG. 1*a*) can be clamped between the second transport means 210 and the second transport means bearing 220 in a slip-resistant manner relative to the second transport means 210.

In the separating device 1 according to the disclosure, the second portion 14 of the blister pouch 10 is therefore not permanently in contact with the second transport means 210 and the second transport means bearing 220, but only when the circular sector rollers 216, 226 are driven accordingly. The second transport means 210 and the second transport means bearing 220 can also be designed as rollers, as described in more detail with reference to the following figures.

As shown, the second portion 14 of the blister tube 10, which temporarily comes into contact with the circular sector rollers 216, 226, is arranged at the longitudinal weld 15 of the blister tube 10, i.e., in a region in which no small piece goods are arranged, which can be advantageous for the contacting and separating (which is described in more detail below).

The first and second portions 13, 14 of the blister tube 10 represent regions of the blister tube 10 that are located in the contact region of the blister tube feed device 100 and of the blister discharging device 200; they thus "travel" across the blister tube 10 when the latter moves in the transport direction TR.

The first and the second drive 111, 211 are coupled to the transport means 110, 210 and the transport means bearings 120, 220, via drive belts 119, 219, in some aspects. It may be provided that the transport means bearings 120, 220 are not driven (if they are only "simple" mating surfaces) or comprise separate drives. In the separating device 1 as shown, the use of a drive is expedient since transport and bearing double rollers 116, 126 and the circular sector rollers 216, 226 are operated at the same rotational speed in each case.

In the event that the transport means bearings 120, 220 are designed as simple mating surfaces and the transport means 110, 210 are designed, as shown, as (double) rollers 116, 126, the portions of the blister pouch 10 slide over the mating surfaces, while they are slip-resistant relative to the transport means 110, 210; only in this way is it ensured that a sufficient tensile force can be built up and, for example, the first portion 13 of the blister pouch 10 does not simply slip through or get pulled through between the transport means 110, 210 and the transport means bearing 120, 220 (before a separation can take place).

In order to achieve the actual separation of two blister pouches 12 at the separation aid 11 arranged between them, it is necessary for a tensile force to be exerted on the second portion 14 of the blister pouch 12, which is achieved by means of the second transport means 210 and the second transport means bearing 220. In the illustrated separating device 1 comprising the circular sector rollers 216, 226, this is achieved by bringing the sector elements of the circular sector rollers 216, 226 into contact with the blister tube 10. For this purpose, the circular sector rollers 216, 226 are rotated by 180° at a rotational speed exceeding the rotational speed of the transport double rollers 116, 126, and are subsequently moved into the initial position, i.e., further rotated by 180°. The angle of rotation depends on the exact design and number of the sector elements. Due to the greater speed and the fact that the blister tube 10 is clamped (and secured against slipping) in the first portion between the transport double rollers 116, 126, a tensile force is induced in the transport direction TR and ensures a separation, at the separation aid, between the first and second portions 13, 14 of the blister tube 10.

The tensile force and the correspondingly necessary clamping effect between the transport double rollers 116, 126 is determined by the design of the separation aid 11; the more material is already severed or weakened, the less tensile force has to be applied. However, since the blister tube 10 runs through the separating device 1 (and the optional upstream blister tube 10 shaping and filling) at a very high speed, the material weakening must not be too large since otherwise there is the risk that the blister tube 10 tears before the separating device 1. In order to control the speeds of the transport double roller 116, 126 and the circular sector rollers 216, 226, the first and second drives 111, 211 are coupled to a control device 20, as is indicated in FIG. 1*b*. The speeds at which the transport double roller 116, 126 and the circular sector rollers 216, 226 have to be rotated in order to exert a corresponding tensile force of course also depends, in this separating device, on the radii.

A small piece goods guide 40 is arranged upstream of the blister tube feed device 100 and guides small piece goods, located in a blister pouch 10, into the central region of a blister pouch 12. Although, due to the relatively low clamping force between the transport means 110, 210 and the transport means bearings 120, 220, it is not harmful if an item of small piece goods finds its way "between" them, a guiding into the center optimizes the separation process per se. As shown, between the transport and bearing rollers 116, 126 of the transport double roller and the bearing double roller, a guide means 130 fastened to the shafts and extending in longitudinal direction between the rollers is arranged and secures the separated blister tube portion vertically against undesired movements (see in particular FIGS. 2*a*, 2*b* and 3). The guide means 130 also support the movement of the blister tube 10, after separation, from the blister tube feed device 100 into or to the blister discharging device 200. If a portion of the blister tube 10 is "guided through" without separation between a number of blister pouches 12, the conveying means help to prevent a "jam" of blister pouches 12 between the aforementioned components.

A device 50 for introducing separation aids 11 between blister pouches 12 of the blister tube 10 is also arranged upstream of the blister tube feed device 100 and, as shown, also upstream of the small piece goods guide 40. In one or more aspects of the disclosure, it can be provided that the separation aids 11 are already introduced into a transverse joining between two blister pouches 12 in the course of the blister-packaging per se, and no independent component is necessary.

FIG. 3 shows a side view of the separating device 1 according to the disclosure, in particular the "larger" components or component sections being illustrated. In the side view, in particular the transport means 110, 210 and transport means bearings 120, 220 arranged vertically one below the other can be seen, which, as shown, have transport rollers 116, 126 and circular sector rollers 216, 226. It can be clearly seen in FIG. 3 that the sector elements 215, 225 of the circular sector rollers 216, 226 are matched to one another in such a way that, in the case of a matched counter-rotating rotational movement of the shafts 217, 227 of the blister discharging device 200, a rotational movement is transmitted to the blister tube 10 (not shown), and in the case of a speed difference between the rotational speed of the circular sector rollers 216, 226 and the transport rollers 116, 126 (which are the same size or have the same radius here), a tensile force is exerted on the second portion 14 of the blister tube (see FIG. 1*a* and the following detailed description of the separation process).

It can be seen in FIGS. 1*a* to 2*a* that the transport means 110, 210 and the associated transport means bearings 120, 220 are designed identically in each case, the first transport means 110 and the first transport means bearing 120 comprising transport and bearing double rollers, but the second transport means 210 and the second transport means bearing 220 not comprising any double rollers, but rather individual circular sector rollers 216 each comprising a circular element 215. In aspects of the disclosure, a plurality of circular sectors can also be present per circular sector roller 216, and it is then also essential again that the circular sector rollers 216 are correspondingly matched to one another.

Figure 4:
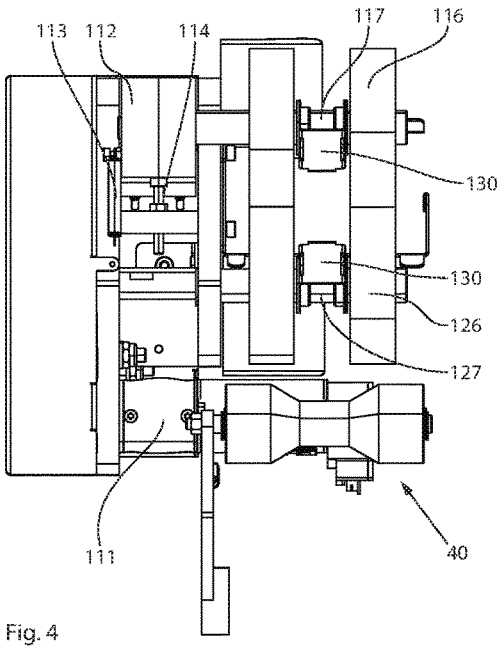
FIG. 4 is a front view of the separating device of FIG. 2*a*, according to the disclosure.

FIG. 4 is a front view of the separating device according to the disclosure, the blister tube per se also being omitted in this view. In this view, it can be seen in particular that the small piece goods guide 40 guides small piece goods arranged in a blister pouch 10 (not shown) toward the region of the blister pouch 10 which does not come into contact with the transport rollers 116, 216. As already stated above, however, it is not absolutely necessary for the fault-free functioning of the separating device 1 per se that all the small piece goods are moved from the region of a blister pouch 12 which comes into contact with the transport rollers 116, 216 or the circular sector rollers 216, 226 (shown in FIGS. 1*a* to 2*b*). In the front view according to FIG. 4, it can be seen that the movable transmission 112, which is moved toward the transport means bearing 120, 220 by a spring means 113, is limited in its movement toward the transport means bearing by a stop 114. In aspects of the transport means 110, 210 and transport means bearings 120, 220, the stop 114 can serve to prevent or limit too strong or "wide" a movement against the blister tube 10 or the current blister pouch 12 when using a pressing or pulling spring. Here, it may otherwise be the case that transport means 110, 210 and transport means bearings 120, 220 designed as rollers "dig into one another."

Figure 5:
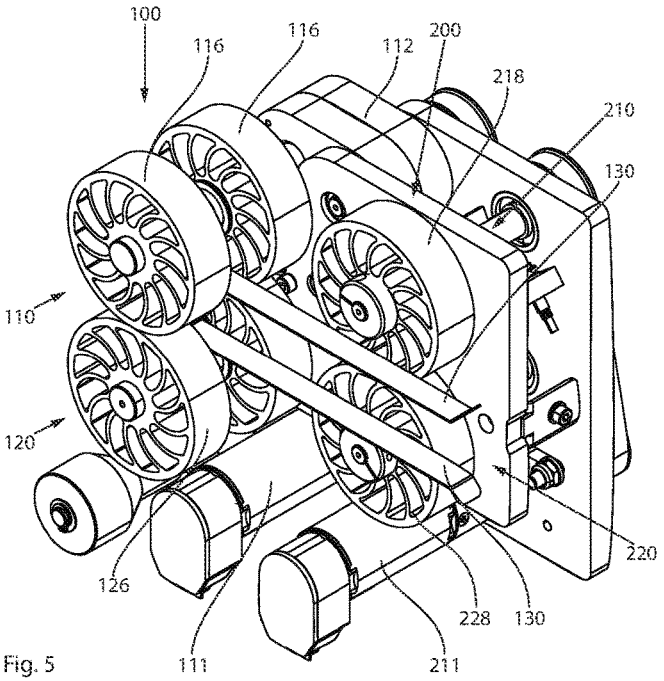
FIG. 5 is a perspective view of a separating device, according to the disclosure.

FIG. 5 shows an oblique view of a separating device 1 according to the disclosure. Here, the second transport means 210 and the second transport means bearing 220 of the blister discharging device 200 do not comprise any circular sector rollers 216 but rather transport and bearing rollers 218, 228 which are designed in a manner corresponding to the transport and bearing rollers 116, 126. Also, the second transport means 210 and the second transport means bearing 220 are designed in such a way that the second portion 14 of the blister tube 10 (see FIGS. 1*a*, 1*b*) can be clamped between the second transport means 210 and the second transport means bearing 220 in a slip-resistant manner relative to the second transport means 210. The way in which this clamping effect can be achieved depends on the exact design of the separating device 1; it is also conceivable here to use a spring means 113 (see corresponding description regarding the blister tube feed device 100) or another height-adjustable arrangement of either the second transport means 210 or the second transport means bearing 220. Further conceivable alternatives are described below with reference to later figures.

Figure 6A:
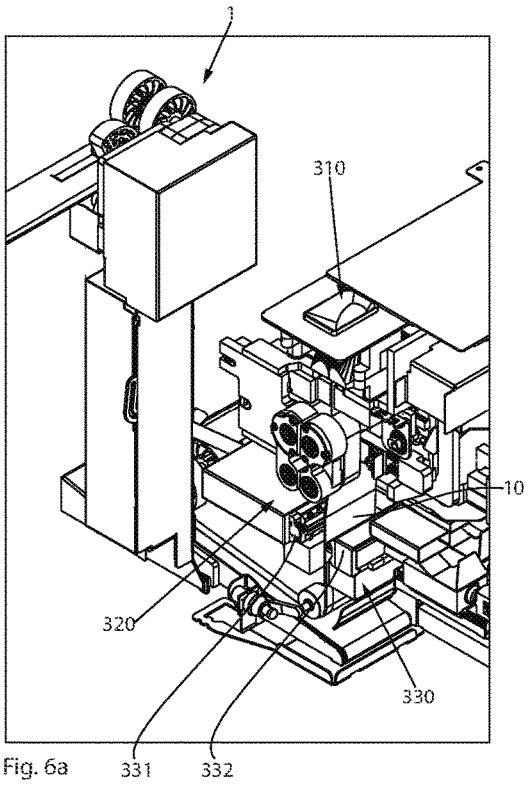
FIGS. 6*a* and 6*b* are perspective partial views of a packaging for small piece goods, according to the disclosure.
Figure 6B:
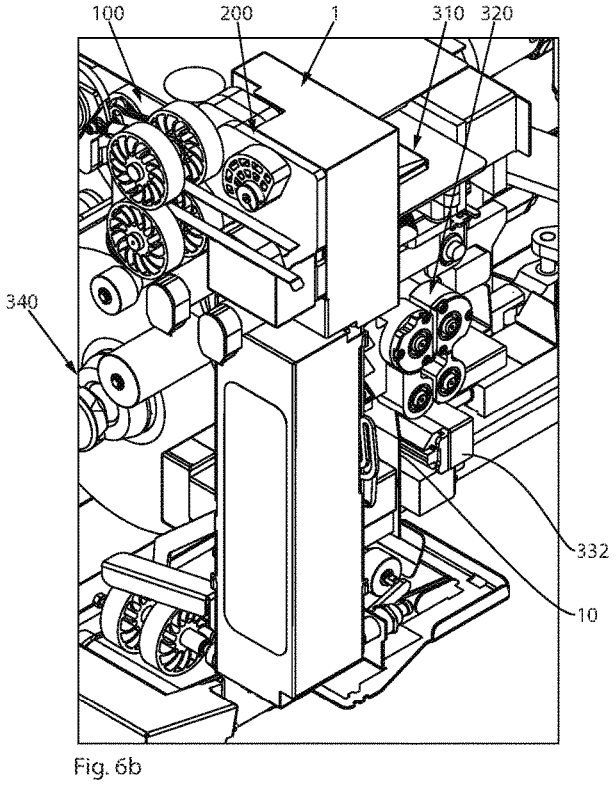

FIGS. 6*a* and 6*b* show oblique views of a packaging device according to the disclosure for small piece goods, the figures being partial views and only the components of the packaging device that are relevant to the disclosure being reproduced. The packaging device according to the disclosure comprises a packaging material guide device 310 for receiving an elongate packaging material web. This packaging material web, which cannot be seen thus in the figures, is fed to the packaging material guide device 310 from a packaging material supply 340 in the form of a roller. The packaging material guide device 310 is designed in such a way that the packaging material web is shaped like a tube in the movement direction. In this tubular shaping, the packaging material web is fed to a longitudinal joining device 320 which is arranged downstream of the packaging material guide device 310 and joins together the tubular packaging material web in the movement direction of the packaging material web, and thus introduces the longitudinal weld 15 which is indicated in FIGS. 1*a* and 1*b*. Downstream of the packaging material guide device 310 and the longitudinal joining device 320, a transverse joining device 330 is arranged, which joins together the shaped packaging material web at predetermined distances transversely to the movement direction to form a transverse joining region (e.g., transverse weld 16), thus forming the blister tube 10 comprising a plurality of blister pouches 12. The transverse joining device 330 comprises two joining means 331, 332, of which at least one is movable transversely to the movement direction. As shown, the transverse joining device 330 furthermore comprises a device for introducing a separation aid 11 into the transverse joining region, this being merely indicated in the figures. In this context, reference is made to the aforementioned European patent application, the disclosure content of which is incorporated in this application, and in which the aforementioned components of the packaging device are disclosed in more detail. The packaging device furthermore comprises a separating device 1 as has been described in more detail with reference to the above figures.

Figure 7A:
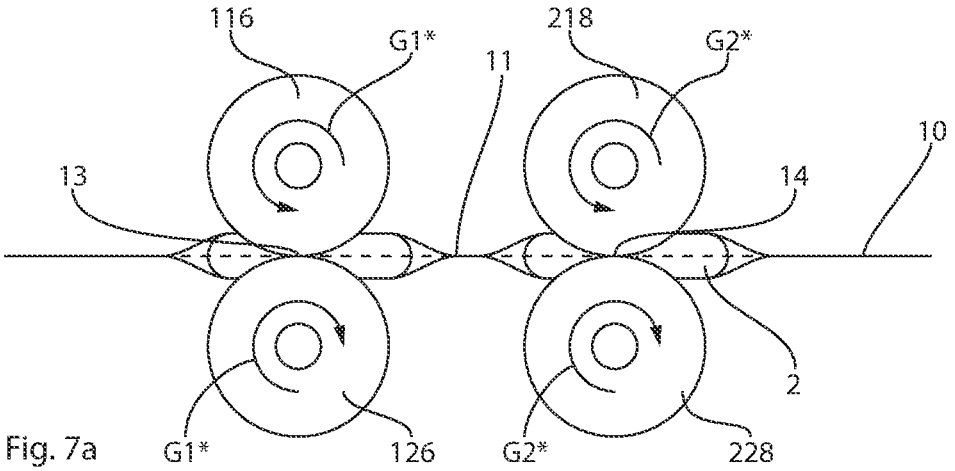
FIGS. 7*a* to 7*c* are schematic depictions of transport means and transport means bearings, according to the disclosure.
Figure 7B:
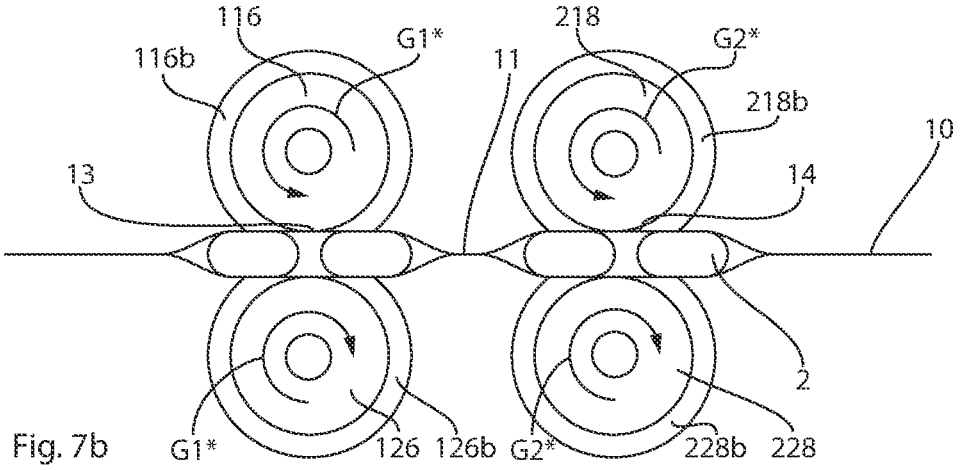
Figure 7C:
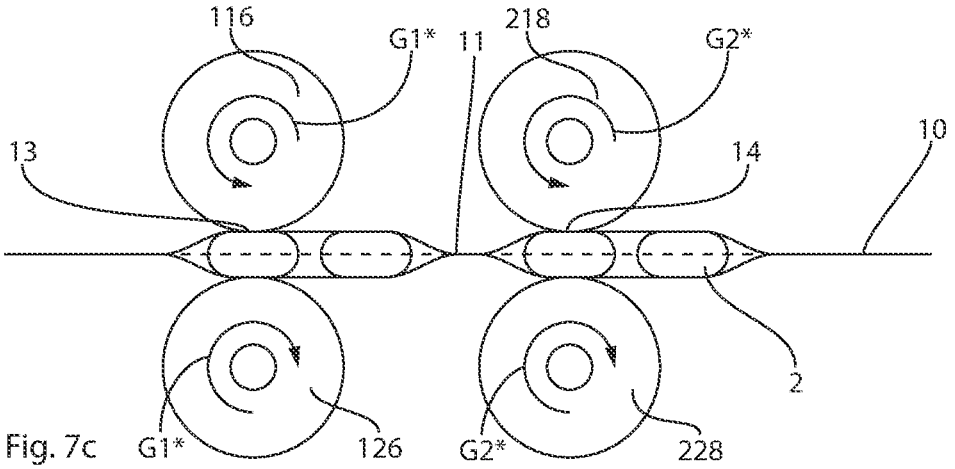

FIGS. 7*a* to 7*c* illustrate a transport device according to the disclosure, transport means and transport means bearings being merely indicated. In FIGS. 7*a* to 7*c*, only parts of the transport means and the transport means bearings of the blister tube feed device 100 and the blister discharging device 200 are indicated, namely transport rollers 116, 218 and bearing rollers 126, 228, the circumferences of all the aforementioned rollers being identical in the transport device of FIGS. 7*a* to 7*c*. As already described in detail above, it is an essential feature of the disclosure that, with the aid of the second transport means 210, a tensile force ZK is exerted on the second portion 14 of the blister tube 10 in the transport direction TR, which force is dimensioned in such a way that the second portion 14 of the blister tube 10 is separated from the first portion 13 of the blister tube 10 at the separation aid 11. In order to be able to apply such a tensile force to the second portion 14, it is firstly essential that the first portion 13 of the blister tube 10 is clamped between the first transport means 110 and the first transport means bearing 210 in such a way that slippage relative to the first transport means 110 is prevented. Furthermore, it is necessary for the second portion 14 to likewise be clamped at least temporarily in such a way that the second portion 14 is prevented from slipping relative to the second transport means 120. If this is ensured, the tensile force causes the second portion 14 to be separated from the first portion 13 at the separation aid 11, provided that the tensile force is correspondingly dimensioned. FIGS. 7*a* to 7*c* illustrate various possibilities for exerting such a tensile force on the second portion 14 of the blister tube 10, the options shown not being exhaustive since all of the options shown are limited to one transport device in which the transport means 110, 210 and the transport means bearings 120, 220 each have rollers. However, even if transport means 110, 210 and the transport means bearings 120, 220 each have rollers, the options shown are not exhaustive. It is also conceivable, for example, to rotate the second transport means 210, designed as a roller, and the second transport means bearing 220 at a higher speed (with the same radius) and to bring it into clamping contact with the second portion 14 of the blister tube 10 only for the separation process per sc.

Alternatives are also conceivable, for example a transport means 110, 210 can have belts or slides which are moved together with the blister tube 10 in the transport direction TR, and between which the blister pouch 12 is (temporarily) clamped.

Since, in the versions of FIGS. 7*a* to 7*c*, the transport means 110, 210 and the transport means bearings 120, 220 each comprise rollers having the same circumference, the rotational speed of these rollers determines the transport speed, which is transmitted to the first portion 13 and second portion 14 of the blister tube 10. In the event that the rotational speed G1* of the first transport roller 116 and the first bearing roller 126 is equal to the rotational speed G2* of the second transport roller 218 and the second bearing roller 228, no tensile force is exerted on the separation aid 11 so that the blister tube 10 is guided between the first portion 13 and the second portion 14 without a separation of the blister tube 10. In the event that the rotational speed G2* is greater than the rotational speed G1*, a discharge speed is induced in the second portion 14 of the blister tube, which is greater than the feed speed which is induced in the first transport roller 116 and the first bearing roller 126. As a result, a tensile force is exerted on the separation aid 11, as a result of which the second portion 14 of the blister tube 10 is separated from the first portion 13.

FIGS. 7*a* to 7*c* show different variants of how the blister tube 10 or the first portion 13 and the second portion 14 of the blister tube 10 can be guided between the transport means 110, 210 and transport means rollers. As shown in FIG. 7*a*, it can be seen that the rollers abut one another at least pictorially and contact only a portion of the blister tube 10 that is at the side in the transport direction TR, which is indicated by the rollers hiding the small piece goods 2 located behind them. In such a case, it is conceivable, for example, for the transport rollers 116, 218 to be pressed or pulled onto the bearing rollers 126, 228 by means of a spring means 113. If the associated shafts are not stationary, it may also be sufficient to load them with a certain weight. Alternatively, it is conceivable that, in the case of stationary shafts of the transport rollers 116, 218, the bearing rollers 126, 228 are pressed or pulled from below against the transport rollers 116, 218 by means of a spring element.

Alternatively, it is conceivable that if, for example, only stationary shafts are used for the transport 116, 218 and bearing rollers 126, 228, a particular coating of these rollers is selected, into which either the tube 10 per se or small piece goods 2 arranged therein are pressed, as illustrated in FIG. 7*b*. For this purpose, for example, a layer made of an elastically deformable material, for example silicone, 116*b*, 126*b*, 218*b*, 228*b*, can be arranged on the outer circumference of the transport rollers 116, 218 and bearing rollers 126, 228. Between the elastically deformable material and the contacted portion of the blister tube 10, referred to here as the first and second portions 13, 14 of the blister tube 10, a corresponding force-fit and, optionally, form-fit is produced, which prevents slippage and ensures that the blister tube 10 is conveyed when the rollers are rotated.

Alternatively, it is also conceivable that transport rollers 116, 218 and/or the bearing rollers 126, 228 are mounted in a height-adjustable manner and are moved toward the respective counter roller but adapt to the height of the blister tube 10 or the small piece goods 2 arranged therein. This is expedient in particular if the lateral region in which no small piece goods 2 are arranged is relatively narrow or the blister pouches 12 are filled with a high number of small piece goods 2. However, such a guidance is expedient only if the necessary clamping force is not so great that there is a risk of damage to the small piece goods 2 arranged in the blister pouches 12.

FIGS. 8*a* to 8*d* illustrate various stages of a method according to the disclosure for separating a blister tube, only plan views of the blister tube and parts of the blister tube feed device and the blister discharging device being indicated.

Figure 8A:
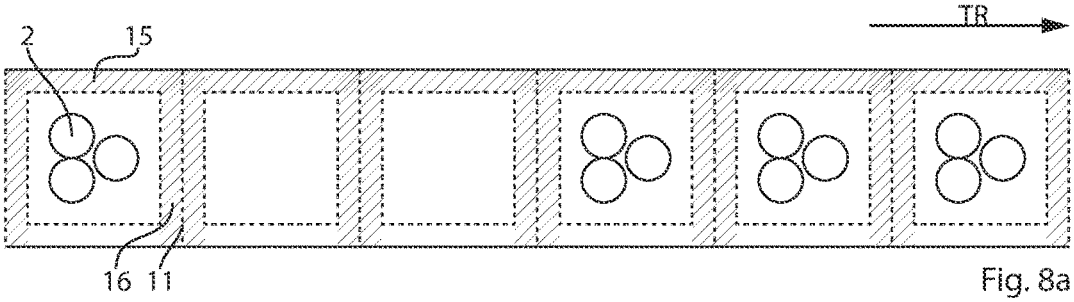
FIGS. 8*a* to 8*d* illustrate various stages of a method for separating a blister tube, according to the disclosure.
Figure 8B:
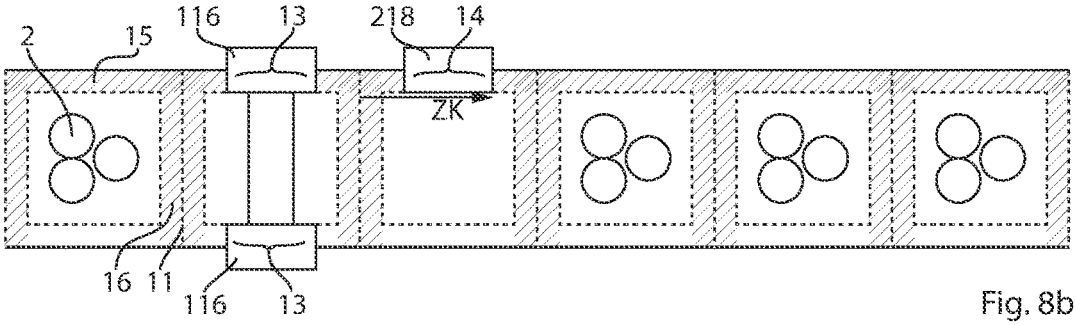
Figure 8C:
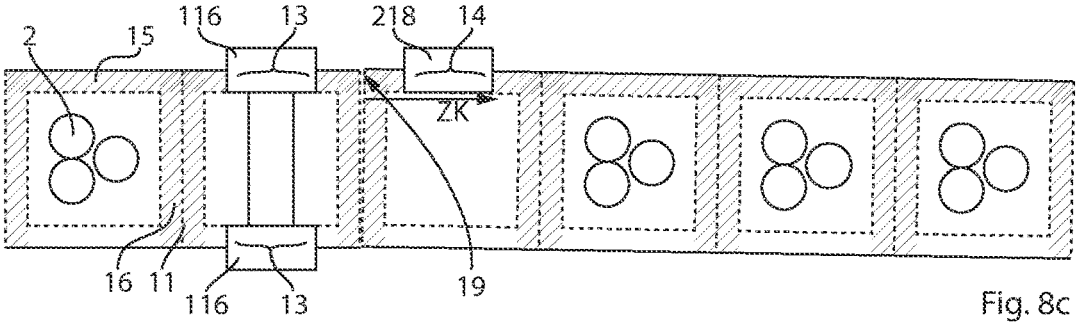
Figure 8D:
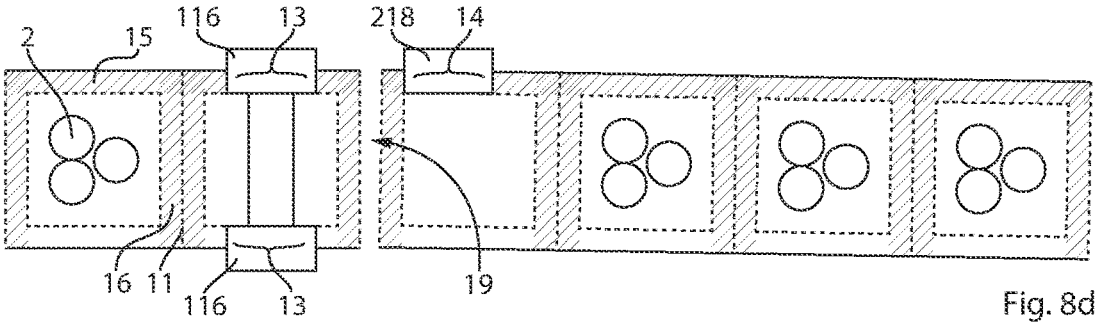

According to the disclosure, a blister tube is first provided in which a separation aid 11 is arranged between individual blister pouches 12. A corresponding blister tube 10 is shown in FIG. 8*a*, in the case of this blister tube 10, a separation aid 11 being indicated between all adjacent blister pouches 12, in a transverse joining region, but this is not absolutely necessary. A separation aid 11 is only necessary between those blister pouches 12 between which a separation is to take place. Furthermore, small piece goods 2 can be seen in the blister tube 10 of FIGS. 8*a* to 8*d*, and the blister tube 10 is provided comprising empty pouches 12 between blister tube segments to be separated, which is likewise not absolutely necessary. The blister tube 10 is fed to a blister tube feed device 100 comprising a first transport means 110 and an associated first transport means bearing 210, and a first portion 13 of the blister tube 10 is guided, clamped between the first transport means 110 and the first transport means bearing 210, in such a way that slippage relative to the first transport means 110 is prevented. In FIGS. 8*b* to 8*d*, the transport means bearings 120, 220 are not discernible due to the plan view; reference is made to previous figures. The blister tube 10 is moved via the clamped first portion 13 by the first transport means 110 in a transport direction TR at a feed speed, which is not shown, as such, graphically in the figures.

The blister tube 10 is fed to a blister discharging device 200 which is arranged downstream of the blister tube feed device 100 and comprises a second transport means 210 and an associated second transport means bearing 220, and a second portion 14 of the blister tube 10 is clamped between the second transport means 210 and the second transport means bearing 220 in a slip-resistant manner relative to the second transport means 210 so that a separation aid 11 is arranged between the blister tube feed device 100 and the blister discharging device 200.

With the aid of the second transport means 210, a tensile force ZK is exerted in the transport direction TR on the second portion 14 of the blister tube 10, which force is dimensioned in such a way that the second portion 14 of the blister tube 10 is separated from the first portion 13 of the blister pouch 12 at the separation aid 11.

In the separating device 1 indicated in FIGS. 8*b* to 8*d*, the first and second transport means 110, 120 comprise transport rollers 116, 218 which each have the same circumference. The tensile force ZK is exerted by reducing the rotational speed of the transport rollers 116 or stopping them but controlling the rotational speed of the transport roller 218 of the second transport means 210 in such a way that it is greater than that of the transport rollers 116 of the first transport means 110. The tensile force ZK, which is primarily induced in the "upper" region as shown, causes the second portion 14 of the blister pouch 10 to be separated in the upper region at the separation aid 11, and a type of crack 19 to extend "downward" through the separation aid and to enlarge, which is indicated in FIGS. 8*c* and 8*d*. As soon as a complete separation has taken place, the rotational speed of the transport rollers 116 can be increased again. The separated portion of the blister tube 10 is subsequently transported away and optionally fed to a storage device, which is however not shown in the figures.

Figure 9:
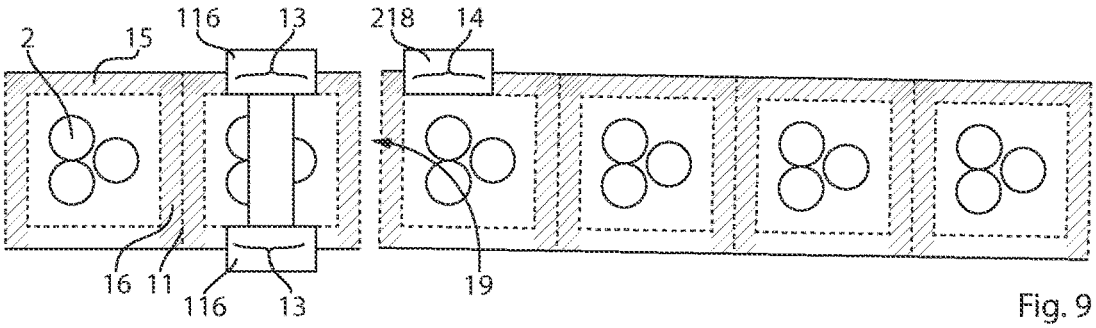
FIG. 9 illustrates a stage of a method for separating a blister tube, according to the disclosure.

FIG. 9 illustrates a stage of a method according to the disclosure, in which a blister tube 10 without empty pouches 12 is separated; FIG. 9 illustrates the stage corresponding to FIG. 8*d*, in which the separation has already taken place.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

The word "exemplary" or the term "for example" is used herein to mean "serving as an example or illustration." Any aspect or design described herein as "exemplary" or "for example" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

The invention claimed is:

1. A separating device for a blister tube having a plurality of blister pouches, comprising:

a blister tube feed device comprising a first transport means and an associated first transport means bearing configured so that a first portion of the blister tube is guided, clamped between the first transport means and the first transport means bearing, in a transport direction so that slippage relative to the first transport means is prevented;

a blister discharging device arranged downstream of the blister tube feed device, the blister discharging device comprising a second transport means and an associated second transport means bearing configured so that a second portion of the blister tube is clamped between the second transport means and the second transport means bearing in a slip-resistant manner relative to the second transport means, wherein the blister tube feed device and the blister discharging device are arranged in such a way that between the first portion and the second portion of the blister tube, a separation aid is arranged between two blister pouches;

a first drive coupled to the first transport means;

a second drive coupled to the second transport means; and a control device coupled to the first drive and to the second drive, wherein the control device is configured to temporarily exert, with the aid of the second transport means, a tensile force in the transport direction on the second portion of the blister tube, the tensile force being dimensioned in such a way that the second portion of the blister tube is separated from the first portion of the blister pouch at the separation aid, wherein the second transport means and the second transport means bearing each have a circular sector roller comprising at least one sector element, the circular sector rollers being matched to one another for contacting the second portion of the blister tube.

2. The separating device of claim 1, wherein at least one of the first and second transport means has an elastically deformable coating in a contact region to the blister tube.

3. The separating device of claim 1, wherein one of:

the first transport means comprises a first spring means, which engages the first transport means against the first transport means bearing; and the second transport means comprises a second spring means, which engages the second transport means against the second transport means bearing.

4. The separating device of claim 3, wherein one of:

the first transport means has a first transport roller, the first transport roller and the first transport means bearing configured so that the first portion of the blister tube is a side region of the blister tube; and the second transport means has a second transport roller, the second transport roller and the second transport means bearing configured so that the second portion of the blister tube is a side region of the blister tube.

5. The separating device of claim 4, wherein one of:

the first transport means bearing has a first bearing roller, the first bearing roller and the first transport roller configured so that the first portion of the blister tube is the side region of the blister tube; and the second transport means bearing has a second bearing roller, the second bearing roller and the second transport roller configured so that the second portion of the blister tube is the side region of the blister tube.

6. The separating device of claim 3, wherein one of:

the first transport means has a first transport double roller, the first transport double roller and the first transport means bearing configured so that the first portion of the blister tube comprises opposing side regions of the blister tube; and the second transport means has a second transport double roller, the second transport double roller and the second transport means bearing configured so that the second portion of the blister tube comprises opposing side regions of the blister tube.

7. The separating device of claim 6, wherein one of:

the first transport means bearing has a first bearing double roller, the first bearing double roller and the first transport double roller configured so that the first portion of the blister tube comprises the opposing side regions of the blister tube; and the second transport means bearing has a second bearing double roller, the second bearing double roller and the second transport double roller configured so that the second portion of the blister tube comprises the opposing side regions of the blister tube.

8. The separating device of claim 1, wherein the separating device has, upstream of the blister tube feed device, a small piece goods guide which guides small piece goods contained in a blister pouch from side regions of a blister pouch into a central region of the blister pouch.

9. The separating device of claim 1, wherein the separating device comprises, upstream of the blister tube feed device, a device for introducing separation aids between blister pouches of the blister tube.

10. A method for separating a blister tube having a plurality of blister pouches, the method comprising:

arranging a separation aid between individual blister pouches of the blister tube;

feeding the blister tube to a blister tube feed device comprising a first transport means and an associated first transport means bearing;

guiding a first portion of the blister tube, clamped between the first transport means and the first transport means bearing, in such a way that slippage relative to the first transport means is prevented;

moving the blister tube via the clamped first portion by the first transport means in a transport direction at a feed speed;

feeding the blister tube to a blister discharging device arranged downstream of the blister tube feed device and comprising a second transport means and an associated second transport means bearing, wherein the second transport means and the second transport means bearing each have a circular sector roller comprising at least one sector element, the circular sector rollers being matched to one another;

clamping, by the matched circular sector rollers, a second portion of the blister tube between the second transport means and the second transport means bearing in a slip-resistant manner relative to the second transport means so that a separation aid is arranged between the blister tube feed device and the blister discharging device; and exerting, with the aid of the second transport means, a tensile force on the second portion of the blister tube in the transport direction, the tensile force being dimensioned in such a way that the second portion of the blister tube is separated from the first portion of the blister pouch at the separation aid.

11. The method of claim 10, wherein the tensile force is exerted by inducing a discharge speed of the second portion by means of the second transport means, which discharge speed is greater than the feed speed.

12. The method of claim 10, wherein the tensile force is exerted by moving the second portion of the blister tube by means of the second transport means in the transport direction at a discharge speed and reducing the feed speed induced by the first transport means relative to the discharge speed.

13. The method of claim 10, wherein the blister tube is provided with the separation aids between the blister pouches in that the separation aids are introduced before the blister tube is fed to the blister tube feed device.

14. A packaging device for small piece goods, comprising:

a packaging material guide device for receiving an elongate packaging material web, the packaging material guide device configured so that the elongate packaging material web is shaped for receiving small piece goods and extends in a movement direction;

a longitudinal joining device arranged downstream of the packaging material guide device, the longitudinal joining device configured to join together the shaped packaging material web at a packaging material overlap region in the movement direction of the packaging material web;

a transverse joining device arranged downstream of the packaging material guide device, the transverse joining device configured to join together the shaped packaging material web at predetermined distances transversely to the movement direction to form a transverse joining region, as a result of which a blister tube comprising a plurality of blister pouches is formed, the transverse joining device comprising two joining devices, of which at least one joining device is movable transversely to the movement direction; and a separating device comprising:

a blister tube feed device comprising a first transport device and an associated first transport device bearing configured so that a first portion of the blister tube is guided, clamped between the first transport device and the first transport device bearing, in a transport direction so that slippage relative to the first transport device is prevented;

a blister discharging device arranged downstream of the blister tube feed device, the blister discharging device comprising a second transport device and an associated second transport device bearing configured so that a second portion of the blister tube is clamped between the second transport device and the second transport device bearing in a slip-resistant manner relative to the second transport device, wherein the blister tube feed device and the blister discharging device are arranged in such a way that between the first portion and the second portion of the blister tube, a separation aid is arranged between two blister pouches;

a first drive coupled to the first transport device;

a second drive coupled to the second transport device;

a control device coupled to the first drive and to the second drive; and one of:

the first transport device has a first transport double roller, the first transport double roller and the first transport device bearing configured so that the first portion of the blister tube comprises opposing side regions of the blister tube; and the second transport device has a second transport double roller, the second transport double roller and the second transport device bearing configured so that the second portion of the blister tube comprises opposing side regions of the blister tube, wherein the control device is configured to temporarily exert, with the aid of the second transport device, a tensile force in the transport direction on the second portion of the blister tube, the tensile force being dimensioned in such a way that the second portion of the blister tube is separated from the first portion of the blister pouch at the separation aid.

15. The packaging device of claim 14, wherein the separating device further comprises one of:

the first transport device comprises a first spring device, which engages the first transport device against the first transport device bearing; and the second transport device comprises a second spring device, which engages the second transport device against the second transport device bearing.

16. The packaging device of claim 15, wherein the separating device further comprises one of:

the first transport device has a first transport roller, the first transport roller and the first transport device bearing configured so that the first portion of the blister tube is a side region of the blister tube; and the second transport device has a second transport roller, the second transport roller and the second transport device bearing configured so that the second portion of the blister tube is a side region of the blister tube.

17. The packaging device of claim 16, wherein the separating device further comprises one of:

the first transport device bearing has a first bearing roller, the first bearing roller and the first transport roller configured so that the first portion of the blister tube is the side region of the blister tube; and the second transport device bearing has a second bearing roller, the second bearing roller and the second transport roller configured so that the second portion of the blister tube is the side region of the blister tube.

18. The packaging device of claim 14, wherein the separating device further comprises one of:

the first transport device bearing has a first bearing double roller, the first bearing double roller and the first transport double roller configured so that the first portion of the blister tube comprises the opposing side regions of the blister tube; and the second transport device bearing has a second bearing double roller, the second bearing double roller and the second transport double roller configured so that the second portion of the blister tube comprises the opposing side regions of the blister tube.

* * * * *